US005944858A

United States Patent [19]

Wallace

[11] Patent Number: 5,944,858

[45] Date of Patent: Aug. 31, 1999

[54] HYDROCARBONACEOUS FUEL COMPOSITIONS AND ADDITIVES THEREFOR

[75] Inventor: Graeme McRobert Wallace, Wokingham, United Kingdom

[73] Assignee: Ethyl Petroleum Additives, Ltd., Bracknell, United Kingdom

[21] Appl. No.: 09/107,577

[22] Filed: Feb. 17, 1998

Related U.S. Application Data

[63] Continuation-in-part of application No. 07/980,629, Nov. 23, 1992, abandoned, which is a continuation of application No. 07/758,632, Sep. 12, 1991, abandoned.

[30] Foreign Application Priority Data

Sep. 20, 1990 [EP] European Pat. Off. ..... 90310322

[51] Int. Cl.[6] ..... C10L 1/30

[52] U.S. Cl. ..... 44/359; 44/347; 44/360; 44/370; 44/373

[58] Field of Search ..... 44/359, 360

[56] References Cited

U.S. PATENT DOCUMENTS

| | | | |
|---|---|---|---|
| 3,015,668 | 1/1962 | Kozikowski | 260/429 |
| 3,094,472 | 6/1963 | Greenwald et al. | 204/162 |
| 3,112,789 | 12/1963 | Percy et al. | 158/117.5 |
| 3,197,414 | 7/1965 | Wood | 252/386 |
| 3,216,936 | 11/1965 | LeSuer | 252/32.7 |
| 3,307,928 | 3/1967 | Chaikivsky et al. | 44/63 |
| 3,582,295 | 6/1971 | Balash | 44/63 |
| 3,701,641 | 10/1972 | Rakaw et al. | 44/421 |
| 3,883,320 | 5/1975 | Strukl | 44/359 |
| 3,891,401 | 6/1975 | Watson et al. | 44/359 |
| 3,909,215 | 9/1975 | Kray | 44/62 |
| 3,927,995 | 12/1975 | Romans | 44/63 |
| 4,022,589 | 5/1977 | Alquist et al. | 44/58 |
| 4,047,900 | 9/1977 | Dorn et al. | 44/68 |
| 4,207,078 | 6/1980 | Sweeney et al. | 44/68 |
| 4,240,801 | 12/1980 | Desmond, Jr. | 44/57 |
| 4,240,803 | 12/1980 | Andress, Jr. | 44/347 |
| 4,247,300 | 1/1981 | Bonazza et al. | 44/63 |
| 4,390,345 | 6/1983 | Somorjai | 44/63 |
| 4,857,073 | 8/1989 | Vataru et al. | 44/57 |
| 5,525,127 | 6/1996 | Jeffrey | 44/359 |
| 5,551,957 | 9/1996 | Cunningham et al. | 44/347 |
| 5,575,823 | 11/1996 | Wallace et al. | 44/359 |
| 5,599,357 | 2/1997 | Leeper | 44/355 |

FOREIGN PATENT DOCUMENTS

| | | |
|---|---|---|
| 0203692 | 12/1986 | European Pat. Off. . |
| 0207560 | 1/1987 | European Pat. Off. . |
| 0235868 | 9/1987 | European Pat. Off. . |
| 0078249 | 10/1987 | European Pat. Off. . |
| 0251419 | 1/1988 | European Pat. Off. . |
| 0355895 | 2/1990 | European Pat. Off. . |
| 0385633 | 9/1990 | European Pat. Off. . |
| 1914338 | 4/1970 | Germany . |
| 0901689 | 7/1962 | United Kingdom . |
| 1413323 | 11/1975 | United Kingdom . |
| 2248068 | 3/1992 | United Kingdom . |
| 8500827 | 2/1985 | WIPO . |
| 8905339 | 6/1989 | WIPO . |

OTHER PUBLICATIONS

Zubarev et al, "Lowering Carbon Deposition in Ship Diesels", Rybn. Khoz. (Moscow), vol. 9, pp. 52–54 (1977).

Shmidt et al, "Use of manganese antiknock compound 2–Ts8 for improving the octane characteristics of gasoline", Neftepererab. Neftekhim. (Moscow)l (11), pp 8–10 (1972).

Keszthelyi et al, "Testing the combustion properties of light fuel oils", *Period. Polytech., Chem. Eng.*, 21(1) pp. 79–93 (1977).

Borisov et al, "Features of the ignition of combustible liquid mixtures", *Dokl. Adak. Nauk SSSR*, 247(5), pp. 1176–1179 (1979).

Mutalibov et al, "Effect of additives on the combustion of fuel for internal–combustion engines", *Dokl. Akad. Naus SSSR*, 250(5) pp. 1194–1196 (1980).

Bartels et al, "Determination of tricarbonylcyclopentadienyl(methyl)manganese JP–4 fuel by atomic absorption spectrophotometry", *Atomic Absorption Newsletter*, 8(1) pp. 3–5 (1969).

Makhov et al, "Effect of cyclopentadienyltricarbonylmanganese additives to diesel fuel on the course of the soot formation process", Margantsevye Antidetonatory, 192–9 (1971).

Belyea, "The CI–2 manganese based additive reduces the concentration of sulfur trioxide in flue gases", Il Calore, No. 3, pp. 135–137 (1967), pp. 1194–1196 (1980).

*Primary Examiner*—Ellen M. McAvoy

*Attorney, Agent, or Firm*—Dennis H. Rainear; Thomas Hamilton

[57] ABSTRACT

Hydrocarbonaceous fuels and additive compositions therefor which comprise: a) one or more fuel-soluble manganese carbonyl compounds; and b) one or more fuel-soluble alkali or alkaline earth metal-containing neutral or basic detergent salts. These compositions preferably contain, in addition to components a) and b) above, one or more of the following: c) one or more fuel-soluble ashless dispersants; d) at least one fuel-soluble demulsifying agent; e) at least one aliphatic or cycloaliphatic amine; and f) at least one metal deactivator. The compositions possess improved combustion characteristics (e.g., formation of less soot, smoke, carbonaceous products and/or noxious emissions), and form on combustion carbonaceous products of reduced acidity. The deposition of sludge on critical engine or burner parts or surfaces is reduced and the fuels have improved stability and demulsibility characteristics. And the fuel compositions can result in decreased fuel consumption in diesel engines.

29 Claims, No Drawings

HYDROCARBONACEOUS FUEL COMPOSITIONS AND ADDITIVES THEREFOR

This application is a continuation-in-part of Ser. No. 07/980,629, filed Nov. 23, 1992, now abandoned; which is a continuation of Ser. No. 07/758,632, filed Sep. 12, 1991, now abandoned.

This invention relates to liquid fuel compositions of enhanced performance properties, particularly as regards combustion characteristics.

Heretofore certain organometallic compounds have been found effective as combustion improvers for distillate fuels such as home heating oils and the like. For example, U.S. Pat. No. 3,112,789 describes the use of cyclopentadienyl manganese tricarbonyls for this purpose, and the compound methylcyclopentadienyl manganese tricarbonyl (MMT) has been sold in the form of a solution in a hydrocarbon diluent as a combustion improver for distillate fuels of this type. Bis (cyclopentadienyl) iron has also been promoted and sold as a combustion improver for use in such fuels.

U.S. Pat. Nos. 3,883,320 and 3,891,401 teach the addition of salts of a transition metal, such as manganese, and an alkaline earth metal, such as calcium, to jet fuels for reducing deposits and smoke. These patents require a manganese/calcium weight ratio of about 5/1 and the combined amounts of metals within the range of from 200 to 600 ppm (200 to 500 ppm in the '401 patent). The present invention requires fuel compositions containing 0.1 to 5 ppm of manganese and only 5 to 50 ppm of an alkali or alkaline earth metal. This gives a manganese/alkali or alkaline earth metal ratio of from 1/1 to 1/500.

Keszthelyi et al. report in *Period. Polytech., Chem. Eng.,* Volume 21(1), pages 79–93 (1977) that in the combustion of light fuel oils in evaporative burners, 0.025% cyclopentadienyl manganese tricarbonyl was effective for soot reduction. And in *Margantsevye Antidetonatory,* edited by A. N. Nesmeyanov, Nauka, Moscow, 1971, at pages 192–199, Makhov et al. report test work indicating that addition of cyclopentadienyl manganese tricarbonyl to diesel fuel reduces the level of smokiness of the exhaust gases.

Zubarev et al. in *Rybn. Khoz.* (*Moscow*), Volume 9, pages 52–4 (1977), report test results on the addition to a fuel mixture of diesel fuel and marine residual fuel of cyclopentadienyl manganese tricarbonyl (CMT) alone or in a blend containing "a scavenger and a solvent". It is indicated that the CMT alone reduced carbon deposits on the intake valves but not on other engine surfaces, and that it reduced smoke. The CMT blend ("Ts8") is reported to have reduced carbon deposition more effectively, especially on the intake valves, cylinder head and piston head.

Canadian Patent No. 1,188,891 describes an additive for fuel oils and diesel fuels and other liquid combustibles and motor fuels designed to improve combustion, reduce soot formation and enhance storage stability. Such additive is composed of at least one oil-soluble or oil-dispersible organic compound of a transition metal or an alkaline earth metal; and at least one oxidation and polymerization inhibitor for hydrocarbons stable at temperatures of at least 300° C. According to the patentee, the presence in such fuels of compounds of transition metals such as copper, manganese, cobalt, nickel and iron accelerate fuel deterioration in accelerated stability tests conducted at 149° C. in the presence of air. Compounds such as MMT, Ferrocene, copper naphthenate, iron naphthenate, and manganese naphthenate are indicated to cause such deterioration in the absence of a high temperature (e.g., 300° C.) stabilizer such as heat-stable alkyl phenols, amines, aminophenols, dithiophosphates, dithiocarbamates and imidazoles and inorganic inhibitors in the form of oxides or hydroxides of aluminum, magnesium or silicon. EP 0078249 B1 is to the same general effect, and indicates that the additive may be a combination of a transition metal compound and an alkaline earth metal compound, as well as either such compound separately.

G.B. Patent No. 1,413,323 describes a multi-component diesel fuel additive to avoid or reduce the formation of deposits on injector parts. The additive comprises, inter alia, an ester of oleic or naphthenic acid having an acid number below 200; a naphthenic acid ester of cresol; an alkoxyalkyl ester of an aliphatic carboxylic acid; an organometallic tricarbonyl cyclopentadiene compound such as cyclopentadienyl manganese tricarbonyl; an amide derivative of a polyolefin obtained by the reaction of a polyolefin substituted succinic acid or anhydride with a polyamine; a copolymer of ethylene and a vinyl (or hydrocarbyl-substituted vinyl) ester of a carboxylic acid wherein the copolymer has a number average molecular weight of more than 3000; a re-odoriser composed of a mixture of natural and synthetic alcohols, ketones and ethers; kerosene; and a petroleum distillate.

U.S. Pat. No. 4,505,718 describes compositions comprising the combination of a transition metal salt such as a manganese carboxylate, and an ashless hydrocarbon-soluble ashless dispersant. An optimum balance between beneficial and deleterious effects is said to be achieved in oils of lubricating viscosity and hydrocarbon fuels.

A need has arisen for a fuel-soluble additive composition for hydrocarbonaceous fuels that is not only capable of reducing the amount of soot, smoke and/or carbonaceous products produced on combustion of the fuel but that is capable of reducing the acidity of the carbonaceous products that result from such combustion. In fulfilling this need, it is also important to provide an additive which prevents or at least inhibits the deposition of sludge on critical engine or burner parts or surfaces and which provides fuel compositions having satisfactory physical properties such as thermal stability and storage stability. It is also highly desirable to provide an additive composition which is capable of reducing or inhibiting the amount of noxious emissions (e.g., carbon monoxide, unburned hydrocarbons, polyaromatic hydrocarbons, and/or particulates) formed when using the fuels in an engine or in a burner or like combustion apparatus. The provision of additive compositions capable of decreasing fuel consumption is also a most desirable objective.

In accordance with one of its embodiments, this invention provides a fuel composition that comprises a major amount of a liquid hydrocarbonaceous fuel and a minor combustion improving amount of an additive composition comprising:

a) one or more fuel-soluble manganese carbonyl compounds; and b) one or more fuel-soluble alkali or alkaline earth metal-containing detergents—e.g., one or more neutral or basic alkali or alkaline earth metal salts of at least one sulphonic acid, and/or at least one carboxylic acid, and/or at least one salicyclic acid, and/or at least one alkylphenol, and/or at least one sulphurised alkylphenol, and/or at least one organic phosphorus acid having at least one carbon-to-phosphorus linkage;

wherein component a) is present in an amount sufficient to supply from 0.1 to 5 ppm manganese to the fuel and component b) is present in an amount sufficient to supply from 5 to 50 ppm alkali and/or alkaline earth metal to the fuel composition.

Pursuant to preferred embodiments of this invention, the additive compositions and fuel compositions are essentially halogen-free, that is, they contain no more than 10 ppm of halogen, if any.

Particularly preferred compositions for use in heating gas oils and similar burner fuels contain, in addition to components a) and b) above, one or more of the following:

c) at least one fuel-soluble ashless dispersant;

d) at least one fuel-soluble demulsifying agent;

e) at least one aliphatic or cycloaliphatic amine; and f) at least one metal deactivator.

Particularly preferred compositions for use in road diesel fuels and similar middle distillate fuels contain, in addition to components a) and b) above, components c) and d), namely, at least one fuel-soluble ashless dispersant and at least one fuel-soluble demulsifying agent.

The above and other embodiments of this invention will become apparent from the ensuing description and appended claims.

As used herein the term "fuel-soluble" means that the compound or component under discussion has sufficient solubility at ordinary ambient temperature in the hydrocarbonaceous fuel in which it is to be used to provide a homogeneous solution containing the compound or component in at least the lowest concentration of the concentration ranges specified herein for such compound or component.

The manganese compounds—component a)—of the compositions of this invention are characterized by being fuel soluble and by having at least one carbonyl group bonded to a manganese atom.

The most desirable general type of manganese carbonyl compounds utilized in accordance with this invention comprise organomanganese polycarbonyl compounds. For best results, use should be made of a cyclopentadienyl manganese tricarbonyl compound of the type described in U.S. Pat. Nos. 2,818,417 and 3,127,351. Thus use can be made of such compounds as cyclopentadienyl manganese tricarbonyl, methylcyclopentadienyl manganese tricarbonyl, ethylcyclopentadienyl manganese tricarbonyl, dimethylcyclopentadienyl manganese tricarbonyl, trimethylcyclopentadienyl manganese tricarbonyl, propylcyclopentadienyl manganese tricarbonyl, isopropylcyclopentadienyl manganese tricarbonyl, butylcyclopentadienyl manganese tricarbonyl, pentylcyclopentadienyl manganese tricarbonyl, hexylcyclopentadienyl manganese tricarbonyl, ethylmethylcyclopentadienyl manganese tricarbonyl, dimethyloctylcyclopentadienyl manganese tricarbonyl, dodecylcyclopentadienyl manganese tricarbonyl, indenyl manganese tricarbonyl, and like compounds in which the cyclopentadienyl moiety contains up to about 18 carbon atoms.

A preferred organomanganese compound is cyclopentadienyl manganese tricarbonyl. Particularly preferred for use in the practice of this invention is methylcyclopentadienyl manganese tricarbonyl.

Methods for the synthesis of cyclopentadienyl manganese tricarbonyls are well documented in the literature. See for example, in addition to U.S. Pat. Nos. 2,818,417 and 3,127,351 noted above, U.S. Pat. Nos. 2,868,816; 2,898,354; 2,960,514; and 2,987,529, among others.

Other organomanganese compounds which may be employed include the non-ionic diamine manganese tricarbonyl halide compounds such as bromo manganese dianiline tricarbonyl and bromo manganese dipyridine tricarbonyl, described in U.S. Pat. No. 2,902,489; the acyl manganese tricarbonyls such as methylacetyl cyclopentadienyl manganese tricarbonyl and benzoyl methyl cyclopentadienyl manganese tricarbonyl, described in U.S. Pat. No. 2,959,604; the aryl manganese pentacarbonyls such as phenyl manganese pentacarbonyl, described in U.S. Pat. No. 3,007,953; and the aromatic cyanomanganese dicarbonyls such as mesitylene cyanomanganese dicarbonyl, described in U.S. Pat. No. 3,042,693. Likewise, use can be made of cyclopentadienyl manganese dicarbonyl compounds of the formula $RMn(CO)_2L$, where R is a substituted or unsubstituted cyclopentadienyl group having 5 to 18 carbon atoms, and L is a ligand, such as an olefin, an amine, a phosphine, $SO_2$, tetrahydrofuran, or the like. Such compounds are referred to, for example in, Herberhold, M., *Metal π-Complexes,* Vol. II, Amsterdam, Elsevier, 1967 or Giordano, P. J. and Weighton, M. S., *Inorg. Chem.,* 1977, 16, 160. Manganese pentacarbonyl dimer (dimanganese decarbonyl) can also be employed if desired.

The manganese carbonyl compounds are used in an amount sufficient to supply from 0.1 to 5 ppm, preferably 0.5 to 3 ppm, manganese to the fuel composition.

The metal-containing detergents are exemplified by oil-soluble neutral and basic salts of alkali or alkaline earth metals with one or more of the following acidic substances (or mixtures thereof): (1) sulphonic acids, (2) carboxylic acids, (3) salicylic acids, (4) alkylphenols, (5) sulphurised alkylphenols, (6) organic phosphorus acids characterised by at least one direct carbon-to-phosphorus linkage. Such organic phosphorus acids include those prepared by the treatment of an olefin polymer (e.g., polyisobutene having a molecular weight of 1000) with a phosphorising agent such as phosphorus trichloride, phosphorus heptasulfide, phosphorus pentasulphide, phosphorus trichloride and sulphur, white phosphorus and a sulphur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulphide at a temperature of about 50° C., and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulphurised alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Examples of suitable metal-containing detergents include, but are not limited to, such substances as lithium phenates, sodium phenates, potassium phenates, calcium phenates, magnesium phenates, sulphurised lithium phenates, sulphurised sodium phenates, sulphurised potassium phenates, sulphurised calcium phenates, and sulphurised magnesium phenates wherein each aromatic group has one or more aliphatic groups to impart hydrocarbon solubility; the basic salts of any of the foregoing phenols or sulphurised phenols (often referred to as "overbased" phenates or "overbased sulphurised phenates"); lithium sulfonates, sodium sulfonates, potassium sulfonates, calcium sulfonates, and magnesium sulfonates wherein each sulphonic acid moiety is attached to an aromatic nucleus which in turn usually contains one or more aliphatic substituents to impart hydrocarbon solubility; the basic salts of any of the foregoing sulfonates (often referred to as "overbased sulfonates"; lithium salicylates, sodium salicylates, potassium salicylates, calcium salicylates, and magnesium salicylates wherein the aromatic moiety is usually substituted by one or more aliphatic substituents to impart hydrocarbon solubility; the basic salts of any of the foregoing salicylates (often referred to as "overbased salicylates"); the lithium, sodium, potassium, calcium and magnesium salts of hydrolysed phosphosulphurised olefins having 10 to 2000 carbon atoms or of hydrolysed phosphosulphurised alcohols and/or aliphatic-substituted phenolic compounds having 10 to 2000 carbon atoms; lithium, sodium, potassium, calcium and magnesium salts of aliphatic carboxylic acids and aliphatic-substituted cycloaliphatic carboxylic acids; the basic salts of the foregoing carboxylic acids (often referred to as "overbased carboxylates" and many other similar alkali and alkaline earth metal salts of oil-soluble organic acids. Mixtures of salts of two or more different alkali and/or alkaline earth metals can be used. Likewise, salts of mixtures of two or more different acids or two or more different types of acids (e.g., one or more calcium phenates with one or more calcium sulfonates) can also be used. While rubidium, cesium and strontium salts are feasible, their expense renders them impractical for most uses. Likewise, while barium salts are effective, the status of barium as a heavy metal under a toxicological cloud renders barium salts less preferred for present-day usage.

The metal-containing detergents are preferably used in an amount sufficient to supply from 5 to 50 ppm, preferably 5 to 25 ppm, alkali and/or alkaline-earth metal to the fuel composition.

Ashless dispersants are described in numerous patent specifications, mainly as additives for use in lubricant compositions, but their use in hydrocarbon fuels has also been described. Ashless dispersants leave little or no metal-containing residue on combustion. They generally contain only carbon, hydrogen, oxygen and in most cases nitrogen, but sometimes contain in addition other non-metallic elements such as phosphorus, sulphur or boron.

When used, the preferred ashless dispersant is an alkenyl succinimide of an amine having at least one primary amino group capable of forming an imide group. Representative examples are given in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with an amine containing at least one primary amino group. The alkenyl succinic anhydride may be made readily by heating a mixture of olefin and maleic anhydride to about 180°–220° C. The olefin is preferably a polymer or copolymer of a lower monoolefin such as ethylene, propylene, isobutene and the like. The more preferred source of alkenyl group is from polyisobutene having a number average molecular weight, as determined by gel permeation chromatography, of up to 10,000 or higher. In a still more preferred embodiment, the alkenyl group is a polyisobutene group having a number average molecular weight of about 500–5,000, and preferably about 900–2,000, especially 900–1,200.

Amines which may be employed in forming the ashless dispersant include any that have at least one primary amino group which can react to form an imide group. A few representative examples are: methylamine, 2-ethylhexylamine, n-dodecylamine, stearylamine, N,N-dimethyl-propanediamine, N-(3-aminopropyl)morpholine, N-dodecyl-propanediamine, N-aminopropyl-piperazine, ethanolamine, N-ethanol-ethylenediamine and the like.

The preferred amines are the alkylene polyamines such as propylene diamine, dipropylene triamine, di-(1,2-butylene) triamine, and tetra-(1,2-propylene)pentanine.

The most preferred amines are the ethylene polyamines that can be depicted by the formula $$H_2N(CH_2CH_2NH)_nH$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end so can form mono-alkenylsuccinimides and bis-alkenylsuccinimides. Commercially available ethylene polyamine mixtures usually contain minor amounts of branched species and cyclic species such as N-aminoethyl piperazine, N,N'-bis (aminoethyl)piperazine, N,N'-bis(piperazinyl)ethane, and like compounds. The preferred commercial mixtures have approximate overall compositions falling in the range corresponding to diethylene triamine to tetraethylene pentamine, mixtures generally corresponding in overall makeup to tetraethylene pentamine being most preferred.

Thus especially preferred ashless dispersants for use in the present invention are the products of reaction of a polyethylene polyamine, e.g. triethylene tetramine or tetraethylene pentamine with a hydrocarbon substituted carboxylic acid or anhydride made by reaction of a polyolefin, preferably polyisobutene, having a number average molecular weight of 500 to 5,000, preferably 900 to 2,000 and especially 900 to 1,200, with an unsaturated polycarboxylic acid or anhydride, e.g., maleic anhydride, maleic acid, fumaric acid, or the like, including mixtures of two or more such substances.

Another class of useful ashless dispersants includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179. The alkenyl succinic portion of these esters corresponds to the alkenyl succinic portion of the succinimides described above including the same preferred and most preferred sub-genus, e.g., polyisobutenyl succinic acids wherein the polyisobutenyl group has a number average molecular weight of 500 to 5,000, preferably 900–2,000, especially 900 to 1,200.

Alcohols useful in preparing the esters include methanol, ethanol, isobutanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

In another embodiment the ashless dispersant is an alkenyl succinic ester-amide mixture. These may be made by heating the above-described alkenyl succinic acids, anhydrides or lower alkyl esters with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol-diethylene triamine, and trimethylol aminomethane.

Representative examples of suitable ester-amide mixtures are described in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Such ashless dispersants containing alkenyl succinic residues may, and as is well known, be post-reacted with boron compounds, phosphorus derivatives and/or carboxylic acid acylating agents, e.g. maleic anhydride.

Another useful class of ashless dispersants includes the Mannich condensates of hydrocarbyl-substituted phenols, formaldehyde or formaldehyde precursors (e.g. paraformaldehyde) and an amine having at least one primary amine group and containing 1–10 amine groups and 1–20 carbon atoms. Mannich condensates useful in this invention are described in U.S. Pat. Nos. 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247; 3,803,039; and 3,413,347.

Representative amine reactants are alkylene polyamines, principally polyethylene polyamines. Other representative organic compounds containing at least one —NHR group, wherein R is either H or alkyl, suitable for use in the preparation of Mannich condensates are well known and include the mono and di-amino alkanes and their substituted analogs, e.g., ethylamine, dimethylamine, and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

The alkylene polyamine reactants which are useful with this invention include polyamines which are linear, branched, or cyclic; or a mixture of linear, branched and/or cyclic polyamines wherein each alkylene group contains from about 1 to about 10 carbon atoms. A preferred polyamine is a polyamine containing from 2 to 10 nitrogen atoms per molecule or a mixture of polyamines containing an average of from about 2 to about 10 nitrogen atoms per molecule such as ethylenediamine, diethylene triamine, triethylene tetramine, tetraethylene pentamine, pentaethylene hexamine, hexaethylene heptamine, heptaethylene octamine, octaethylene nonamine, nonaethylene decamine, and mixtures of such amines. Corresponding propylene polyamines such as propylene diamine, and dipropylene triamine, tripropylene tetramine, tetrapropylene pentamine, pentapropylene hexamine are also suitable reactants. In selecting an appropriate polyamine, consideration should be given to the compatibility of the resulting detergent/dispersant with the gasoline fuel mixture with which it is mixed.

The alkylene polyamines are usually obtained by the reaction of ammonia and dihaloalkanes, such as dichloroalkanes. Thus, the alkylene polyamines are obtained from the reaction of 2 to 11 moles of ammonia with 1 to 10 moles of dichloroalkanes having 2 to 6 carbon atoms and chlorine atoms on different carbon atoms.

Another preferred amine of this invention is an aliphatic polyamine having one and only one primary or secondary amino group in the molecule capable of entering into the Mannich condensation reaction with the hydroxyaromatic compound and the aldehyde. The other amino group(s) is/are usually tertiary or quaternary ammonium groups, preferably a single tertiary amino group. However they can be one or more secondary amino groups that are sterically hindered to such an extent as to be substantially incapable of directly participating in the Mannich condensation reaction.

Representative of these types of amine reactants are alkylene polyamines having, inter alia, a single suitably reactive primary or secondary amino group in the molecule. Other substituents such as hydroxyl, cyano, amido, etc., can be present in the polyamine. Preferably the amine is an aliphatic diamine having one primary or secondary amino group and one tertiary amino group in the molecule. Examples of suitable polyamines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), N,N-dihydroxyalkyl-1,3-alkylenediamines (one terminal tertiary amino group and one terminal primary amino group), N,N,N'-trihydroxyalkyl-1,3-alkylenediamines (one terminal tertiary amino group and one terminal secondary amino group), tris(dialkylaminoalkyl) aminoalkylmethanes (three terminal tertiary amino groups and one terminal primary amino group), and like compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants of this type are N,N-dialkyl-1,3-alkylenediamine, such as those having from 3 to about 6 carbon atoms in the alkylene group and from 1 to about 12 carbon atoms in each of the alkyl groups, which most preferably are the same but which can be different. Most preferred is N,N-dimethyl-1,3-propanediamine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propanediamine, N-(tert-butyl)- 1-methyl-1,2-ethanediamine, N-(tert-butyl)-1-methyl-1,3-propanediamine, and 3,5-di(tert-butyl) aminoethylpiperazine.

More preferred Mannich condensates are those made by condensing a polyisobutenyl phenol wherein the polyisobutyl group has an average molecular weight of about 800–3,000 with formaldehyde or a formaldehyde precursor and an ethylene polyamine having the formula:

$$H_2N(CH_2CH_2NH)_nH$$

wherein n is an integer from one to ten or mixtures thereof especially those in which n has an average value of 3–5.

Typical post-treated ashless dispersants such as succinimides and Mannich condensates are described in U.S. Pat.

Nos. 3,036,003; 3,087,936; 3,200,107; 3,216,936; 3,254,025; 3,256,185; 3,278,550; 3,280,234; 3,281,428; 3,282,955; 3,312,619; 3,366,569; 3,367,943; 3,373,111; 3,403,102; 3,442,808; 3,455,831; 3,455,832; 3,493,520; 3,502,677; 3,513,093; 3,533,945; 3,539,633; 3,573,010; 3,579,450; 3,591,598; 3,600,372; 3,639,242; 3,649,229; 3,649,659; 3,658,846; 3,697,574; 3,702,575; 3,703,536; 3,704,308; 3,708,422; and 4,857,214.

A further type of ashless dispersants which can be used comprises interpolymers of oil-solubilising monomers such as decyl methacrylate, vinyl decyl ether and high molecular weight olefins with monomers containing polar substituents, e.g., aminoalkyl acrylates or acrylamides and poly (oxyethylene)-substituted acrylates. These may be characterised as "polymeric dispersants" and examples thereof are disclosed in the following U.S. Pat. Nos.: 3,329,658; 3,449,250; 3,519,565; 565; 3,666,730; 3,687,849; and 3,702,300.

Another class of ashless dispersants which can advantageously be used in the fuel compositions of this invention are the imidazoline dispersants which can be represented by the formula:

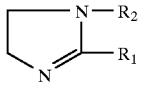

wherein $R_1$ represents a hydrocarbon group having 1 to 30 carbon atoms, e.g. an alkyl or alkenyl group having 7 to 22 carbon atoms, and $R_2$ represents a hydrogen atoms or a hydrocarbon radical of 1 to 22 carbon atoms, or an aminoalkyl, acylaminoalkyl or hydroxyalkyl radical having 2 to 50 carbon atoms. Such long-chain alkyl (or long-chain alkenyl) imidazoline compounds may be made by reaction of a corresponding long-chain fatty acid (of formula $R_1$—COOH), for example oleic acid, with an appropriate polyamine. The imidazoline formed is then ordinarily called, for example, oleylimidazoline where the radical $R_1$ represents the oleyl residue of oleic acid. Other suitable alkyl substituents in the 2-position of these imidazolines include undecyl, heptadecyl, lauryl and erucyl. Suitable N-substituents of the imidazolines (i.e. radicals $R_2$) include hydrocarbyl groups, hydroxyalkyl groups, aminoalkyl groups, and acylaminoalkyl groups. Examples of the foregoing groups include methyl, butyl, decyl, cyclohexyl, phenyl, benzyl, tolyl, hydroxyethyl, aminoethyl, oleylaminoethyl and stearylaminoethyl.

Other suitable ashless dispersants which may be incorporated in the fuel compositions of this invention include the products of condensation of a cyclic anhydride with a straight-chain N-alkylpolyamine of the formula:

$$R—(NH—R'—)_n—NH_2$$

where n is an integer at least equal to 1, usually 3 to 5, R is a saturated or unsaturated linear hydrocarbon radical of 10 to 22 carbon atoms and R' is a divalent alkylene or alkylidene radical of 1 to 6 carbon atoms. Examples of such polyamines include N-oleyl-1,3-propanediamine, N-stearyl-1,3-propanediamine, N-oleyl-1,3-butanediamine, -oleyl-2-methyl-1,3-propanediamine, N-oleyl-1,3-pentanediamine, N-oleyl-2-ethyl-1,3-propanediamine, N-stearyl-1,3-butanediamine, N-stearyl-2-methyl-1,3-propanediamine, N-stearyl-1,3-pentanediamine, N-stearyl-2-ethyl-1,3-propanediamine, N-oleyl-dipropylenetriamine and N-stearyldipropylenetriamine. Such linear N-alkylpolyamines are condensed with, e.g., a succinic, maleic, phthalic or hexahydrophthalic acid anhydride which may be substituted by one or more radicals of up to 5 carbon atoms each.

Another class of ashless dispersant which can be incorporated in the compositions of the present invention are the products of reaction of an ethoxylated amine made by reaction of ammonia with ethylene oxide with a carboxylic acid of 8 to 30 carbon atoms. The ethoxylated amine may be, for example, mono-, di- or tri-ethanolamine or a polyethoxylated derivative thereof, and the carboxylic acid may be, for example, a straight or branched chain fatty acid of 10 to 22 carbon atoms, a naphthenic acid, a resinic acid or an alkyl aryl carboxylic acid.

Still another type of ashless dispersants which can be used in the practise of this invention are the α-olefin-maleimide copolymers such as are described in U.S. Pat. No. 3,909,215. Such copolymers are alternating copolymers of N-substituted maleimides and aliphatic α-olefins of from 8 to 30 carbon atoms. The copolymers may have an average of 4 to 20 maleimide groups per molecule. The substituents on the nitrogen of the maleimide may be the same or different and are organic radicals composed essentially of carbon, hydrogen and nitrogen having a total of 3 to 60 carbon atoms. A commercially available material which is highly suitable for use in this invention is Chevron OFA 425B, and this material is believed to be or comprise an α-olefin maleimide copolymer of the type described in U.S. Pat. No. 3,909,215.

All the aforesaid types of ashless dispersants are described in the literature and many are available commercially. Mixtures of various types of ashless dispersants can, of course, be used.

Because of environmental concerns it is desirable to employ ashless dispersants which contain little, if any, halogen atoms such as chlorine atoms. Thus, in order to satisfy such concerns, it is desirable (although not necessary from a performance standpoint) to select ashless dispersants (as well as the other components used in the compositions of this invention) such that the total halogen content of the overall fuel composition does not exceed 10 ppm. Most desirably, the additive composition contains no detectable amount of halogen.

Typical halogen (e.g., chlorine)-free ashless dispersants suitable for use in the compositions of this invention include, in addition to various types described hereinabove, those described in the following published applications: WO 90/03359 and EP 365288.

A variety of materials are available for use in those preferred embodiments of this invention in which at least one demulsifying agent is employed as component d) along with components a) and b). The demulsifying agent improves the water tolerance level of the fuel compositions by minimizing or preventing excessive emulsion formation.

Exemplary demulsifiers which may be employed in the practise of this invention include poly(alkylphenol) formaldehyde condensates and the polyalkylenoxy modified reaction products thereof. These compounds are prepared by reacting an alkylphenol with formaldehyde and thereafter reacting the reaction product of the above with a $C_2$ to $C_6$ alkylene oxide such as ethylene oxide and propylene oxide. The demulsifiers have a generalized structural formula

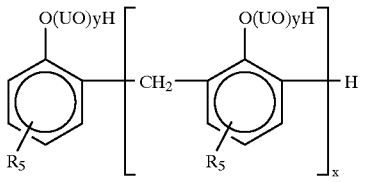

wherein U is an alkylene of 2 to 6 carbons; y is an integer averaging between 4 and 10; x is an integer averaging between 4 and 10; and $R_5$ is an alkyl having from 4 to 15 carbon atoms.

Preferred demulsifiers described by the above formula are polyethyleneoxy modified methylene bridged poly (alkylphenol) polymers having a polyethyleneoxy chain of 8 to 20 carbons and preferably from 10 to 16 carbons and at least about 75 number percent of the polyethyleneoxy chains being within the range specified. The methylene bridged poly(alkylphenol) portion of the polymer has from 4 to 10 and preferably from 5 to 8 repeating methylene bridged alkylphenol units with 4 to 15 and preferably 6 to 12 carbons in the alkyl group. In preferred embodiments, the alkyl groups are a mixture of alkyls having between 4 and 12 carbon atoms.

Illustrative alkylphenols include p-isobutylphenol, p-diisobutylphenol, p-hexylphenol, p-heptylphenol, p-octylphenol, p-tripropylenephenol, and p-dipropylenephenol, etc.

Another type of demulsifier component is an ammonia-neutralised sulfonated alkylphenol. These compounds have the general structure:

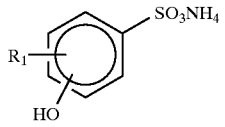

wherein $R_1$ is a hydrocarbyl group having from 4 to 15 carbon atoms, preferably from 6 to 12.

These compounds are prepared by sulphonating an alkylated phenol and thereafter neutralising the sulfonated product with ammonia.

Another type of demulsifier is an oxyalkylated glycol. These compounds are prepared by reacting a polyhydroxy alcohol such as ethylene glycol, trimethylene glycol, etc., with ethylene or propylene oxide. Many of the compounds are commercially available from BASF-Wyandotte Chemical Company under the PLURONIC trademark. They are polyethers terminated by hydroxy groups and produced by the block copolymerisation of ethylene oxide and propylene oxide. The ethylene oxide blocks act as the hydrophiles and the propylene oxide blocks as the hydrophobes. They are available in a wide range of molecular weights and with varying ratios of ethylene oxide to propylene oxide.

One type of commercially available demulsifiers comprises a mixture of alkylaryl sulfonates, polyoxyalkylene glycols and oxyalkylated alkylphenolic resins. Such products are supplied by Petrolite Corporation under the TOLAD trademark. One such propriety product, identified as TOLAD™ 286K, is understood to be a mixture of these components dissolved in a solvent composed of alkyl benzenes. This product has been found efficacious for use in the compositions of this invention. A related product, TOLAD™ 286, is also suitable. In this case the product apparently contains the same kind of active ingredients dissolved in a solvent composed of heavy aromatic naphtha and isopropanol. However, other known demulsifiers can be used.

In the embodiments of this invention wherein component e) is used, a wide variety of suitable amines are available. This component contributes stability to the systems in which it is employed. Typically, component e) is a monoamine although polyamines can be used, if desired. Among the vast array of suitable amines are included the amines referred to in U.S. Pat. No. 3,909,215 such as tertiary alkyl primary amines including PRIMENE® 81R and the like, and amines referred to in EP 188,042, namely alkyldimethylamines in which the alkyl group has 8 to 14 carbon atoms or mixtures thereof. Also suitable are mixed alkyl-cycloalkyl amines such as N-cyclohexyl-N-butyl amine, N-methylcyclohexyl-N-octyl amine, etc., as well as di- and tricycloalkyl amines such as N,N-dicyclohexyl amine, N,N-di-(ethylcyclohexyl) amine, N,N,N-tricyclohexyl amine, and the like. Preferred amines include N-cycloalkyl-N,N-dialkyl amines and N-cycloalkenyl-N,N-dialkylamines such as N-cyclohexyl-N,N-diethyl amine, N-cyclohexyl-N,N-dibutyl amine, N-cycloheptyl-N,N-dimethyl amine, N-cyclooctyl-N,N-dilauryl amine, N-cyclohexenyl-N,N-dipropyl amine, and like compounds. Particularly preferred is N-cyclohexyl-N,N-dimethyl amine. Mixtures of various amines, such as those referred to above, are also suitable for use in accordance with this invention.

Generally speaking, metal deactivators fall into two broad categories. One category comprises the passivators that are considered to react with the metal surface and thereby passivate the surface. The other category comprises the chelators, i.e., substances that have the capability of reacting or complexing with dissolved metal and/or metal ions. An example of the passivator type is the thiadiazoles such as HITEC® 314 additive (available from Ethyl Corporation). Examples of the chelator type of metal deactivators include 8-hydroxyquinoline, ethylene diamine tetracarboxylic acid, β-diketones such as acetylacetone, β-ketoesters such as octyl acetoacetate, and the like. The preferred metal deactivators which are generally regarded as chelators, are Schiff bases, such as N,N'-disalicylidene-1,2-ethanediamine, N,N'-disalicylidene-1,2-propanediamine, N,N'-disalicylidene-1,2-cyclohexanediamine, and N,N"-disalicylidene-N'-methyldipropylenetriamine. Thus, a wide variety of known metal deactivators are available for use as component f) in the embodiments of this invention which involve use of a metal deactivator.

A particular advantage associated with the use of the metal deactivators, especially of the Schiff base chelator type, is their ability to overcome instability caused in certain hydrocarbonaceous base fuels by the presence of typical manganese carbonyl compounds such as the cyclopentadienyl manganese tricarbonyls in combination with typical metal detergents. The most preferred metal deactivators of this type are N,N'-disalicylidene-1,2-alkanediamines and N,N'-disalicylidene-1,2-cycloalkanediamines, especially N,N'-disalicylidene-1,2-propanediamine. Mixtures of metal deactivators can be used.

When used, the metal deactivators are present in an amount sufficient to increase the thermal oxidative stability if said fuel compositions.

In principle, the advantages of this invention may be achieved in any liquid hydrocarbonaceous fuel derived from petroleum, coal, shale and/or tar sands. In most instances, at least under present circumstances, the base fuels will be derived primarily, if not exclusively, from petroleum.

The invention is thus applicable to such fuels as kerosene, jet fuel, aviation fuel, diesel fuel, home heating oil, light cycle oil, heavy cycle oil, light gas oil, heavy gas oil, bunker fuels, residual fuel oils, ultra heavy fuel oils, and in general, any liquid (or flowable) hydrocarbonaceous product suitable for combustion either in an engine (e.g., diesel fuel, gas turbine fuels, etc.) or in a burner apparatus (e.g., gas oils, inland heavy fuel oil, residual fuel oils, visbreaker fuel oils, home heating oils, etc.). Other suitable fuels may include liquid fuels derived from biomass, such as vegetable oils (e.g., rapeseed oil, jojoba oil, cottonseed oil, etc.); or refuse-derived liquid fuels such as fuels derived from municipal and/or industrial wastes; or waste oils and/or liquid waste biomass and its derivatives; or mixtures of any of the foregoing substances.

In many cases, specifications exist for various hydrocarbonaceous fuels or grades thereof, and in any event, the nature and character of such fuels are well-known and reported in the literature.

The additive compositions comprising components a) and b) and at least one of components c), d), e) and f)—preferably two of components c), d), e) and f) and most preferably all of components c), d), e) and f)—are especially useful in heating gas oils and like burner fuels and fuel oils for agricultural and industrial engines. Typical specifications for such fuel oils can be found, for example, in BS 2869: Part 2: 1988 of the British Standards Institution. Typical specifications for automotive or road diesel fuels, in which compositions composed of components a), b), c) and d) are especially useful, appear in BS 2869: Part 1: 1988 of the British Standards Institution. As can be appreciated, a vast number of such specifications exist from country to country.

In general, the components of the additive compositions are employed in the fuels in minor amounts sufficient to improve the combustion characteristics and properties of the base hydrocarbonaceous fuel in which they are employed. The amounts will thus vary in accordance with such factors as base fuel type and service conditions for which the finished fuel is intended. However, generally speaking, the following concentrations (ppm) of the metals, contributed by components a) and b), in the base fuels are illustrative:

| | General Range | More Preferred Range |
|---|---|---|
| Component a) | 0.1–5 | 0.5–3 |
| Component b) | 5–50 | 5–25 |

In the case of fuels additionally containing one or more of components c), d), e), and f), the following concentrations (ppm) of active ingredients are typical:

| | General Range | Preferred Range | Particularly Preferred Range |
|---|---|---|---|
| Component c) | 0–15,000 | 7–10,000 | 8–5,000 |
| Component d) | 0–4,000 | 0.5–200 | 2–50 |
| Component e) | 0–10,000 | 5–200 | 10–50 |
| Component f) | 0–6,000 | 0.5–1,000 | 1.5–100 |

It will be appreciated that the individual components a) and b) and also c), d), e), and/or f) (if used), can be separately blended into the fuel or can be blended therein in various sub-combinations, if desired. Ordinarily, the particular sequence of such blending steps is not critical. Moreover, such components can be blended in the form of a solution in a diluent. It is preferable, however, to blend the components used in the form of an additive concentrate of this invention, as this simplifies the blending operations, reduces the likelihood of blending errors, and takes advantage of the compatibility and solubility characteristics afforded by the overall concentrate.

The additive concentrates of this invention will contain components a) and b) and optionally, but preferably, one or more of components c), d), e), and f) in amounts proportioned to yield fuel blends consistent with the concentrations tabulated above. In most cases, the additive concentrate will contain one or more diluents such as light mineral oils, to facilitate handling and blending of the concentrate. Thus, concentrates containing up to 90% by weight of one or more diluents or solvents are frequently used.

If desired or deemed of help in given situations, one or more other components can be included in the compositions of this invention. For example, the additive compositions and fuel compositions of this invention can also contain antioxidant, e.g., one or more phenolic antioxidants, aromatic amine antioxidants, sulphurized phenolic antioxidants, and organic phosphites, among others. Examples include 2,6-di-tert-butylphenol, liquid mixtures of tertiary butylated phenols, 2,6-di-tert-butyl-4-methylphenol, 4,4'-methylene-bis (2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, phenyl-α-naphthyl amine, and phenyl-β-naphthyl amine.

Corrosion inhibitors comprise another type of optional additive for use in this invention. Thus use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of corrosion inhibitor for use in the practise of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Preferred materials are the aminosuccinic acids or derivatives thereof represented by the formula:

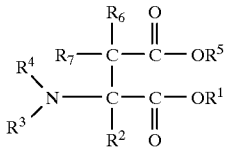

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, $R^6$ and $R^7$, when in the form of a hydrocarbyl group, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably, a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred is a dialkylester of an aminosuccinic acid of the above formula wherein $R^1$ and $R^5$ are isobutyl, $R^2$ is a hydrogen atom, $R^3$ is octadecyl and/or octadecenyl and $R^4$is 3-carboxy-1-oxo-2-propenyl. In such ester $R^6$ and $R^7$ are most preferably hydrogen atoms.

The heavier fuels of this invention may contain cold flow improvers and pour-point depressants, e.g., olefin/vinyl acetate copolymers such as ethylene/vinyl acetate copolymers and polymethacrylates. Antifoam agents such as silicones, and dyes can also be used in the compositions of this invention. The diesel fuels may contain cetane improvers such as peroxy compounds and organic nitrates (e.g., amyl nitrates, hexyl nitrates, heptyl nitrates, octyl nitrates, and other alkyl nitrates having about 4 to about 10 carbon atoms including mixtures thereof). A few specific examples of such alkyl nitrates are cyclohexyl nitrate, methoxypropyl nitrate, mixed nitrate esters made by nitration of fusel oil, 2-ethylhexyl nitrate, n-octyl nitrate, n-decyl nitrate, etc. Typical peroxy compounds include acetyl peroxide, benzoyl peroxide, tert-butylperoxyacetate, and cumene hydroperoxide.

All of the foregoing optional other components are well known in the art and are used in the usual proportions. In selecting such optional component(s), care should be taken to ensure that the selected material or combination of material is compatible with components of the overall composition in which it is being used.

The following non-limiting examples in which all parts and percentages are by weight illustrate the invention.

EXAMPLE 1

An additive composition is formed by blending the following components in the amounts specified:

4.0% Methylcyclopentadienyl manganese tricarbonyl (MMT) as a blend containing 62% MMT and 38% diluent (mainly aromatic solvent);
6.0% Overbased calcium sulfonate as a blend with 44% 100 solvent neutral oil and having a typical TBN of 295;
6.9% Chevron OFA 425B, an ashless dispersant believed to comprise a $C_{13}/C_{16}$ α-olefin-maleic anhydride copolymer aminated with an N-alkylpropylene diamine as a 50% solution in oil;
5.2% N-cyclohexyl-N,N-dimethylamine;
1.6% N,N'-disalicylidene-1,2-propanediamine as an 80% solution in xylene; and
76.3% Heavy aromatic naphtha.

This composition is well adapted for use in heating gas oil, for example at treat rates of 15 to 800 ppm, typically 500 ppm.

EXAMPLE 2

An additive composition of this invention is formed using the following:

4.0% MMT as the 62% solution in diluent specified in Example 1;
6.0% Overbased calcium sulfonate as the blend in 100 solvent neutral oil specified in Example 1;
5.5% Polyisobutenyl succinimide of tetraethylene pentamine (made from polybutenes with Mn of approximately 950) as a 25% solution in oil;
1.4% Akzo ARMOGARD™ D5021 demulsifier, believed to be a blend of demulsifier bases and surfactants in an aromatic solvent;
5.2% N-cyclohexyl-N,N-dimethylamine;
1.6% N,N'-disalicylidene-1,2-propanediamine as an 80% solution in heavy aromatic naphtha; and
76.3% Heavy aromatic naphtha.

This composition is useful, for example at treat rates of 15 to 800 ppm, typically 500 ppm, in heating gas oils.

EXAMPLE 3

Using the procedure of Example 1, the following components are blended together:

4.5% MMT blend specified in Example 1;
33.0% Overbased calcium sulfonate blend specified in Example 1;
22.7% Polyisobutenyl succinimide of tetraethylene pentamine (made from polybutene of Mn of approximately 950) as a 23% solution in a solvent oil;
6.8% Demulsifier (Tolad 286K); and
33.0% Heavy aromatic naphtha diluent.

When used, for example at a concentration in the range of 15 to 700 ppm, typically 400 ppm, this additive concentrate is especially adapted for improving combustion of road diesel fuels.

EXAMPLE 4

An additive concentrate is formed using the following components:

2.8% MMT;
14.5% Overbased calcium sulfonate blend;
17.1% Polyisobutenyl succinimide of an equivalent mixture of diethylene triamine, triethylene tetramine, and tetraethylene pentamine (made from polyisobutene of Mn of approximately 1000); and
65.6% Inert diluents (primarily 100 solvent neutral mineral oil).

EXAMPLE 5

The following additive concentrate is formed:

5.0% Cyclopentadienyl manganese tricarbonyl in a blend containing 40% aromatic hydrocarbon solvent;
30.5% Overbased magnesium sulfonate;
24.5% Mannich condensation product of p-(polyisobutenyl)-phenol (made from polyisobutene of Mn of 750), formaldehyde and triethylene tetramine;
5.6% Akzo ARMOGARD™ D5021 demulsifier; and
34.4% Heavy aromatic naphtha diluents.

EXAMPLE 6

Examples 4 and 5 are repeated substituting in one case overbased potassium sulfonate and in another case overbased calcium phenate for the sulfonates of Examples 4 and 5.

EXAMPLE 7

The procedures of Examples 1 through 3 are repeated except that in one case the overbased calcium sulfonate is replaced by an equivalent amount of overbased magnesium sulfonate, in another case by an equivalent amount of overbased sodium sulfonate, and in a third case by an equivalent amount of overbased potassium sulfonate.

EXAMPLE 8

The respective compositions of Examples 1 through 3 are formed with the exception that the methylcyclopentadienyl manganese tricarbonyl is replaced in one case by an equivalent amount of cyclopentadienyl manganese tricarbonyl, in another case by an equivalent amount of cyclopentadienyl manganese dicarboxyl triphenylphosphine, in a third case by an equivalent amount of indenyl manganese tricarbonyl, in a fourth case by an equivalent amount of dimanganese decacarbonyl, and in still another case by an equivalent amount of a mixture composed of 90% methylcyclopentadienyl manganese tricarbonyl and 10% cyclopentadienyl manganese tricarbonyl.

EXAMPLE 9

The respective compositions of Examples 1 and 2 are blended at concentrations of 300 and 500 ppm in a heating gas oil having a specific gravity at 15° C. (DIN 51 757) of 0.845 g/mL, a kinematic viscosity at 20° C. (DIN 51 562) of 5.3 $mm^2$ per second, a pour point (DIN ISO 3016) of −9° C., a sulphur content (DIN 51 400) of 0.19%, and a distillation profile (DIN 51 751) of 27 volume % boiling to 250° C. and 92 volume % boiling to 350° C.

EXAMPLE 10

Example 9 is repeated except that the same amounts of the respective components of the respective compositions of Examples 1 and 2 are blended individually or in sub-combinations into the gas oil.

EXAMPLE 11

The composition of Example 3 is blended at concentrations of 300 and 500 ppm in a diesel fuel satisfying the requirements of DIN 51 601-DK (February 1986).

EXAMPLE 12

Example 11 is repeated except that the same amounts of the respective components of the composition of Example 3 are blended individually or in sub-combinations into the diesel fuel.

EXAMPLE 13

The procedures of Examples 11 and 12 are repeated using commercially available diesel fuels suitable for use as railway diesel fuel, tractor diesel fuel, off-road diesel fuel and inland waterways fuel.

EXAMPLE 14

Examples 9 and 10 are repeated using as the fuels commercially-available heavy fuel oils and residual oils (e.g., industrial and refinery fuel oils) such as inland heavy fuel oils, and also hydrocarbonaceous marine fuels. The additive treat levels in these fuels are 500 and 800 ppm.

EXAMPLE 15

An additive composition is formed by blending the following components in the amounts specified:

4.0% Methylcyclopentadienyl manganese tricarbonyl (MMT) as a blend containing 62% MMT and 38% diluent (mainly aromatic solvent);
6.0% Overbased calcium sulfonate as a blend with 44% 100 solvent neutral oil and having a typical TBN of 295;
9.2% Chevron OFA 425B, an ashless dispersant believed to comprise a $C_{13}/C_{16}$ α-olefin-maleic anhydride copolymer aminated with an N-alkylpropylene diamine as a 50% solution in oil;
9.2% N-cyclohexyl-N,N-dimethylamine;
1.6% N,N'-disalicylidene-1,2-propanediamine as an 80% solution in xylene; and
70.0% Heavy aromatic naphtha.

This composition is well adapted for use in heating gas oil, for example at treat rates of 15 to 800 ppm, typically 500 ppm.

EXAMPLE 16

The procedure of Example 15 is repeated using the following proportions of the additive components:

4.0% MMT as the blend of Example 15;
6.0% Overbased calcium sulfonate as the blend of Example 15;
6.9% Chevron OFA 425B, as the solution of Example 15;
6.9% N-cyclohexyl-N,N-dimethylamine;
1.2% N,N'-disalicylidene-1,2-propanediamine as the solution of Example 15; and
75.0% Heavy aromatic naphtha.

EXAMPLE 17

The procedure of Example 15 is repeated using the following proportions of the additive components:

4.0% MMT as the blend of Example 15;
6.0% Overbased calcium sulfonate as the blend of Example 15;
6.9% Chevron OFA 425B, as the solution of Example 15;
5.2% N-cyclohexyl-N,N-dimethylamine;
1.2% N,N'-disalicylidene-1,2-propanediamine as the solution of Example 15; and
76.7% Heavy aromatic naphtha.

The effectiveness and advantageous characteristics of the compositions of this invention are illustrated by the results of a number of standardized tests. For example, an 81 kW gas oil-fired hot water boiler was operated with a flue gas temperature of 207° C., a carbon dioxide flue gas content of 12.1% and a carbon monoxide flue gas content of above 100 ppm. The base heating gas oil was as specified in Example 9. Operation of the boiler on the additive-free gas oil gave a Bacharach soot number of 4.60 whereas the same gas oil containing 500 ppm of the additive composition of Example 1 gave a Bacharach soot number of 2.70, a 41% reduction. Measurements of the acidity of the soot (an average of 4 determinations) showed that the clear base gas oil produced a soot with an average pH of 4.05. In contrast, the soot from the fuel of this invention had a pH averaging 7.06.

Standard CFR engine tests (ASTM D613) were conducted using two different diesel fuels having cetane values of 52.7 (Fuel A) and 52.5 (Fuel B), respectively. Addition of 500 ppm of the composition of Example 1 to Fuel A caused no change in cetane rating. In Fuel B only a slight loss in cetane value (from 52.5 to 51.6) occurred by addition of 500 ppm of the composition of Example 1.

The same pair of diesel fuels was subjected to standard corrosion tests (ASTM 665A), both with and without 500 ppm of the additive composition of Example 1. The results of these tests were as follows:

| Rating Per ASTM 665A | |
|---|---|
| Fuel A without additives | D, D |
| Fuel A with additives | A, A |
| Fuel B without additives | B, B+ |
| Fuel B with additive | A, A |

The same fuels were subjected to thermal stability tests wherein the sample is heated at 150° C. for 90 minutes, filtered through a filter and the reflectance of the deposit on the filter measured. The rating scale ranges from 0 (clean) to 20 (black). A rating of 7 or less is considered good. Thermal oxidative stability tests according to ASTM D 2274 were also performed on these fuels. The performance in these tests is expressed in terms of milligrams of deposit per 100 milliliters of fuel. The results were as follows:

| | Thermal Stability (Filter Tests) | Thermal Oxidative Stability (ASTM D2274) |
|---|---|---|
| Fuel A without additives[a] | — | 0.31 |
| Fuel A with additives[b] | — | 0.23 |
| Fuel A with additives[c] | — | 0.09 |
| Fuel B without additives | 11 | 1.86 |
| Fuel B with additives[b] | 5 | 0.09 |
| Fuel B with additives[d] | — | 0.09 |
| Fuel B without additives[a] | — | 1.59 |
| Fuel B with additives[e] | — | 0.34 |
| Fuel B with additives[ac] | — | 0.05 |

a Average of two tests.
b Additive composition of Example 1.
c Additive Composition of Example 15.
d Additive Composition of Example 17.
e Additive Composition of Example 16.

Diesel fuels both with and without the additive composition of this invention as set forth in Example 2 were subjected to standard corrosion tests (ASTM 665A) and (ASTM 665B). The results were as follows:

| | Rating Per ASTM 665A | Rating Per ASTM 665B |
|---|---|---|
| Fuel A without additives | C, C | B, E |
| Fuel A with additives | A, A | E, E |
| Fuel B without additives | B+, B+ | D, D |
| Fuel B with additives | A, A | D, D |

The same compositions were subjected to thermal stability tests wherein the sample is heated at 150° C. for 90 minutes, filtered through a filter and the reflectance of the deposit on the filter measured. The rating scale ranges from 0 (clean) to 20 (black). A rating of 7 or less is considered good. Thermal oxidative stability tests according to ASTM D 2274 were also performed on these fuel compositions. The performance in these tests is expressed in terms of milligrams of deposit per 100 milliliters of fuel. The results were as follows:

| | Thermal Stability (Filter Tests) | Thermal Oxidative Stability (ASTM D2274) |
|---|---|---|
| Fuel A without additives | 6 | 0.15 |
| Fuel A with additives | 3 | 0.17 |
| Fuel B without additives | 19 | 4.45 |
| Fuel B with additives | 6 | 0.14 |

Demulsification tests (ASTM D 1094) on the same four fuels gave the results shown below:

| | Interface Rating | Separation Rating | Volume of Aqueous Phase, mL |
|---|---|---|---|
| Fuel A without additives | 4 | 3 | 17 |
| Fuel A with additives | 3 | 3 | 18 |
| Fuel B without additives | 4 | 3 | 7 |
| Fuel B with additives | 3 | 3 | 19 |

Additional tests were run using commercially available domestic heating gas oil in order to determine performance in two different burners. One was a modem burner whereas the other was a burner produced fifteen years ago. In each case the burners were adjusted to the manufacturers specifications. The additive compositions of Examples 1 and 2 were utilized in these tests together with baseline runs on the clear base fuel. Measurements were made of the smoke number and for carbon monoxide content of the flue gases. The smoke number determinations involve a scale ranging from 0 to 10, which ratings are applied to a filter through which the flue gas was passed during the operation. A rating of 10 means black and thus the lower the number, the better. The carbon monoxide ratings are expressed in terms of parts per million in the flue gas. The following table summarizes these data.

| | Old Burner | | New Burner | |
|---|---|---|---|---|
| | Smoke No. | CO | Smoke No. | CO |
| Base fuel without additives | 5.5 | 80 | 1 | 90 |
| Base fuel with additives[a] | 5.5 | 43 | — | — |
| Base fuel with additives[b] | 4.5 | 40 | 0 | 20 |

a Additive composition of Example 1 at 500 ppm
b Additive composition of Example 2 at 500 ppm Engine tests were conducted using a Mercedes Benz OM 364A 4-liter, 4-cylinder, turbocharged diesel engine run at full load and variable speeds. Determinations were made of fuel consumption of a conventional additive-free diesel fuel and the same base fuel containing the additive composition of Example 3 at a concentration of 400 ppm. The data are summarized in the following table.

| Engine | Fuel Consumption, g/Kw-hr | |
|---|---|---|
| Speed, rpm | Fuel Without Additives | Fuel With Additives |
| 1000 | 236 | 225 |
| 1600 | 212 | 208 |
| 2200 | 216 | 213 |

The tailpipe emissions produced by the same pair of fuel compositions were also determined during operation of the above Mercedes-Benz diesel engine. It was found that the emission of hydrocarbons was reduced from 0.627 grams per horsepower hour to 0.527 grams per horsepower hour by the presence in the fuel of the 400 ppm of the additive composition of Example 3. Likewise, the total particulates emitted by the clear fuel amounted to 0.3574 grams per horsepower hour whereas the total particulates emitted by the fuel containing 400 ppm of the additive composition of Example 3 amounted to only 0.3063 grams per horsepower hour. These reductions were achieved without significant change in NO*x* and carbon monoxide emission levels.

Emission of polyaromatic hydrocarbons (expressed in terms of nanograms of polyaromatic hydrocarbons per milligram of particulate emissions) was also determined on the Mercedes-Benz diesel engine using the same pair of fuel compositions. The average results from two tests on each fuel at each of two dynamometer load levels with the engine operating at 1560 rpm were as follows:

| | Engine Load Level | |
|---|---|---|
| | 50% | 75% |
| Fuel Without Additives | 600 | 1100 |
| Fuel With Additives | 350 | 650 |

The above and other test results have indicated that the fuels of this invention generally possess enhanced combustion properties (e.g., less smoke, lower soot acidity) and better thermal stability than the corresponding untreated fuels. In addition, use of the fuels containing the additives of the present invention results in the formation of reduced amounts of sludge deposits on critical engine or burner parts or surfaces. Further, such fuels tend to emit smaller amounts of noxious emissions than the corresponding untreated base fuels. In addition, this invention enables the provision of fuel compositions having enhanced demulsification properties and reduced corrosion tendencies with minimal interference with other desirable fuel properties. The results of the foregoing tests also indicate that the additive compositions of this invention can result in decreased fuel consumption in diesel engines. The data also indicate that all fuels do not necessarily respond to the same extent to treatment with the additive systems of this invention. Nonetheless, as a general proposition, the fuels of this invention do have significantly improved properties.

It will be seen from the foregoing that this invention includes among its embodiments methods of improving the combustion characteristics of an at least predominantly hydrocarbonaceous liquid fuel which comprises blending therewith a minor combustion-improving amount of:

a) at least one fuel-soluble manganese carbonyl compound; and b) at least one fuel-soluble alkali or alkaline earth metal-containing detergent.

Such compositions preferably contain one or more of components c), d), e) and f) as described hereinabove.

Also included among the embodiments of this invention are methods of improving the combustion characteristics of an at least predominantly hydrocarbonaceous liquid fuel during combustion in an engine, burner, or other combustion apparatus which comprises operating said engine, burner or other combustion apparatus on an at least predominantly hydrocarbonaceous liquid fuel containing a minor combustion-improving amount of:

a) at least one fuel-soluble manganese carbonyl compound; and b) at least one fuel-soluble alkali or alkaline earth metal-containing detergent.

Here again, the fuel composition preferably contains one or more of components c), d), e) and f) as described hereinabove.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

I claim:

1. A fuel composition which comprises a major amount of a liquid hydrocarbonaceous fuel and a minor combustion-improving amount of a) at least one fuel-soluble manganese carbonyl compound; and b) at least one fuel-soluble alkali or alkaline earth metal-containing detergent, wherein component a) is present in an amount sufficient to supply from 0.1 to 5 ppm manganese to the fuel composition and component b) is present in an amount sufficient to supply from 5 to 50 ppm alkali and/or alkaline earth metal to the fuel composition.

2. The composition of claim 1 wherein component a) comprises at least one cyclopentadienyl manganese tricarbonyl compound.

3. The composition of claim 2 wherein component a) consists essentially of methylcyclopentadienyl manganese tricarbonyl.

4. The composition of claim 1 wherein component b) comprises at least one overbased alkali or alkaline earth metal-containing detergent.

5. The composition of claim 4 wherein component b) consists essentially of at least one sulfonate detergent.

6. The composition of claim 5 wherein component b) consists essentially of at least one overbased calcium sulfonate detergent.

7. The composition of claim 1 further comprising c) an ashless dispersant.

8. The composition of claim 7 wherein component c) consists essentially of at least one basic nitrogen-containing ashless dispersant.

9. The composition of claim 8 wherein component c) consists essentially of at least one succinimide ashless dispersant.

10. The composition of claim 9 wherein component c) consists essentially of at least one polyolefin-substituted succinimide of at least one polyethylene polyamine having an overall average composition falling within the range of triethylene tetramine to pentaethylene hexamine.

11. The composition of claim 10 wherein component c) consists essentially of at least one polyisobutenyl succinimide of a mixture of acyclic and cyclic polyethylene polyamine species, which mixture has the approximate composition corresponding to tetraethylene pentamine.

12. The compositions of claim 11 wherein component c) consists essentially of at least one polyisobutenyl succinimide of a mixture of acyclic and cyclic polyethylene polyamine species, which mixture has the approximate composition corresponding to tetraethylene pentamine, the polyisobutenyl substituent of the succinimide having a number average molecular weight in the range of about 900–2,000.

13. The composition of claim 1 further comprising d) at least one fuel-soluble demulsifying agent.

14. The composition of claim 1 further comprising e) at least one fuel-soluble aliphatic or cycloaliphatic amine.

15. The composition of claim 14 wherein component e) is at least one fuel-soluble N-cycloalkyl-N,N-dialkylamine.

16. The composition of claim 15 wherein component e) is N-cyclohexyl-N,N-dimethylamine.

17. The composition of claim 1 further comprising f) at least one fuel-soluble metal deactivator.

18. The composition of claim 17 wherein f) is at least one fuel-soluble metal deactivator of the chelator type.

19. The composition of claim 18 wherein f) is selected from the group consisting of at least one fuel-soluble N,N'-disalicylidene-1,2-alkanediamine, at least one N,N'-disalicylidene-1,2-cycloalkanediamine and a combination thereof.

20. The composition of claim 19 wherein f) is N,N'-disalicylidene-1,2-propanediamine.

21. A method of improving the combustion characteristics of an at least predominantly hydrocarbonaceous liquid fuel which comprises blending therewith a minor combustion-improving amount of:

a) at least one fuel-soluble manganese carbonyl compound; and b) at least one fuel-soluble alkali or alkaline earth metal-containing detergent, wherein component a) is present in an amount sufficient to supply from 0.1 to 5 ppm manganese to the fuel composition and component b) is present in an amount sufficient to supply from 5 to 50 ppm alkali and/or alkaline earth metal to the fuel composition.

22. The method of claim 21 wherein component a) is at least one fuel-soluble cyclopentadienyl manganese tricarbonyl compound; and component b) is a calcium sulfonate.

23. The method of claim 21 wherein the fuel additionally contains at least one fuel-soluble ashlesss dispersant, at least one fuel-soluble demulsifying agent, at least one aliphatic or cycloaliphatic amine, at least one metal deactivator or a combination thereof.

24. A method of improving the combustion characteristics of an at least predominantly hydrocarbonaceous liquid fuel during combustion in an engine, burner, or other combustion apparatus which comprises operating said engine, burner or other combustion apparatus on an at least predominantly hydrocarbonaceous liquid fuel containing a minor combustion-improving amount of:

a) at least one fuel-soluble manganese carbonyl compound; and b) at least one fuel-soluble alkali or alkaline earth metal-containing detergent, wherein component a) is present in an amount sufficient to supply from 0.1 to 5 ppm manganese to the fuel composition and component b) is present in an amount sufficient to supply from 5 to 50 ppm alkali and/or alkaline earth metal to the fuel composition.

25. The method of claim 24 wherein component a) is at least one fuel-soluble cyclopentadienyl manganese tricarbonyl compound; and component b) is a calcium sulfonate.

26. The method of claim 24 wherein the fuel additionally contains at least one fuel-soluble ashlesss dispersant, at least one fuel-soluble demulsifying agent, at least one aliphatic or cycloaliphatic amine, at least one metal deactivator or a combination thereof.

27. A fuel composition which comprises a major amount of a liquid hydrocarbonaceous fuel and a minor combustion-improving amount of a) at least one fuel-soluble manganese carbonyl compound; and b) at least one fuel-soluble alkali or alkaline earth metal-containing detergent;

c) an ashless dispersant; and f) a metal deactivator;

wherein component a) is present in an amount sufficient to supply from 0.1 to 5 ppm manganese to the fuel composition and component b) is present in an amount sufficient to supply from 5 to 50 ppm alkali and/or alkaline earth metal to the fuel composition.

28. A method of improving the combustion characteristics of an at least predominantly hydrocarbonaceous liquid fuel which comprises blending therewith a minor combustion-improving amount of:

a) at least one fuel-soluble manganese carbonyl compound; and b) at least one fuel-soluble alkali or alkaline earth metal-containing detergent;

c) an ashless dispersant; and f) a metal deactivator;

wherein component a) is present in an amount sufficient to supply from 0.1 to 5 ppm manganese to the fuel composition and component b) is present in an amount sufficient to supply from 5 to 50 ppm alkali and/or alkaline earth metal to the fuel composition.

29. A method of improving the combustion characteristics of an at least predominantly hydrocarbonaceous liquid fuel during combustion in an engine, burner, or other combustion apparatus which comprises operating said engine, burner or other combustion apparatus on an at least predominantly hydrocarbonaceous liquid fuel containing a minor combustion-improving amount of:

a) at least one fuel-soluble manganese carbonyl compound; and b) at least one fuel-soluble alkali or alkaline earth metal-containing detergent;

c) an ashless dispersant; and f) a metal deactivator;

wherein component a) is present in an amount sufficient to supply from 0.1 to 5 ppm manganese to the fuel composition and component b) is present in an amount sufficient to supply from 5 to 50 ppm alkali and/or alkaline earth metal to the fuel composition.

* * * * *